United States Patent [19]

Bärnthaler et al.

[11] Patent Number: 4,878,714

[45] Date of Patent: Nov. 7, 1989

[54] CUTTING MACHINE FOR CUTTING AND CARRYING AWAY MATERIAL FROM A WORK FACE

[75] Inventors: Franz Bärnthaler, Weissenkirchen; Krzysztof Rutkowski, Vienna, both of Austria

[73] Assignee: Voest-Alpine Aktiengesellschaft, Linz, Austria

[21] Appl. No.: 251,707

[22] PCT Filed: Nov. 26, 1987

[86] PCT No.: PCT/AT87/00072

§ 371 Date: Aug. 22, 1988

§ 102(e) Date: Aug. 22, 1988

[87] PCT Pub. No.: WO88/03985

PCT Pub. Date: Jun. 2, 1988

[30] Foreign Application Priority Data

Nov. 26, 1986 [AT] Austria ..... 3162/86

[51] Int. Cl.[4] ..... F21D 9/10; F21D 9/12

[52] U.S. Cl. ..... 299/67; 299/76

[58] Field of Search ..... 299/64, 66, 67, 73, 299/75, 76; 198/312, 510.1

[56] References Cited

U.S. PATENT DOCUMENTS 3,966,258 6/1976 Dolecki ..... 299/64 X

FOREIGN PATENT DOCUMENTS 3402032 8/1985 Fed. Rep. of Germany .
2389756 12/1978 France .
2570434 3/1986 France .
977829 12/1982 U.S.S.R. ..... 299/64
2163798 3/1986 United Kingdom .
2164685 3/1986 United Kingdom .

*Primary Examiner*—Jerome W. Massie, IV
*Assistant Examiner*—David J. Bagnell
*Attorney, Agent, or Firm*—Cushman, Darby & Cushman

[57] ABSTRACT

Then invention relates to a cutting machine having cutting heads or drums which are supported to be freely rotating on a pivoting cutting arm, with a loading ramp or conveyor which extends in the direction to the work face to receive and transport the cut material, the loading ramp or conveyor being supported on the machine frame to be displaceable in the longitudinal direction of the cutting machine. The pivot axis of the cutting arm, which axis extends at right angles to the longitudinal direction of the machine, is provided to be adjustable relative to the machine frame in the longitudinal direction of the machine. The adjusting movement of the horizontal pivot axis of the cutting arm is coupled to that of the loading ramp or conveyor.

5 Claims, 2 Drawing Sheets

CUTTING MACHINE FOR CUTTING AND CARRYING AWAY MATERIAL FROM A WORK FACE

BACKGROUND OF THE INVENTION

The invention relates to a cutting machine having cutting heads or drums which are rotatably supported on a swivelling cutting arm, with a loading ramp or conveyor extending in the direction to the work face to receive and transport the cut material.

From Austrian Patent No. 380 730, a cutting machine having an all-round swivelling boom, at the free end of which at least one cutting head is rotatably supported, has become known, a collecting channel being arranged below the cutting head for the cut material being connected with the boom carrying the cutting head, such a design of a collecting channel being arranged below the cutting head making superfluous the provision of a loading ramp. In the case of the cutting machine disclosed in Austrian Patent No. 380 728, there are connected to the cutting arm at both sides of the cutting arm in each case one worm conveyor for rearward transportaion, the front end of the cutting arm being in the region of the cutting head. The cut material is therefore transported away by the worm conveyors arranged laterally of the cutting arm, the conveyor worms being surrounded by a housing which is designed to be open on that side facing away from the cutting arm.

Known arrangements of the kind mentioned above are disclosed, for example, in U.S. Pat. No. 3,966,258, having swivelling loading ramps or conveying means, which may be chain conveyors, in the front region facing the work face. The loading ramp is usually located below the rotatably supported cutting heads, with the result that the material cut by the cutting heads falls on to the loading ramp. In the case of such arrangements it is, however, necessary to take steps to prevent a collision between cutting arm and loading ramp. The position of the loading ramp for the purpose of receiving the cut material is adjusted by displacement of the machine. When cutting a drift, as a rule, the entire machine is therefore displaced, thus simultaneously advancing the loading ramp to an appropriate position.

SUMMARY OF THE INVENTION

On the basis of a cutting machine of the kind mentioned at the outset, the invention aims at making possible an exact positioning of the loading ramp or conveying means even when the cutting machine is not displaced. To meet this object, the invention essentially is characterized in that the loading ramp or conveyor is supported on the machine frame to be displaceable in the longitudinal direction of the cutting machine. As a result of the fact that the loading ramp or conveyor is supported on the machine frame to be displaceable in the longitudinal direction of the cutting machine, an adjustment of the loading ramp can be undertaken, irrespective of the position of the machine itself, and thus, in particular when it is intended to cut with the cutting heads close to the floor, such a loading ramp can simply be drawn back in order to avoid a collision with the cutting appliances. Such an arrangement is particularly advantageous in connection with known cutting machines in the case of which the horizontal pivotal axis of the cutting arm, which axis extends at right angles to the longitudinal direction of the machine, is provided to be adjustable in the longitudinal direction of the machine relative to the machine frame. In the case of such cutting machines, a drift can be cut without displacement of the machine itself, the pivotal axis of the cutting arm being relocated forward in the direction of the work face. In the case of such an arrangement, it is particularly advantageous if the adjusting movement of the horizontal pivotal axis of the cutting arm is coupled with the adjusting movement of the loading ramp or conveyor, so that the possibility is given to advance the loading means simultaneously with the cutting of a new drift with the advancing movement of the pivotal axis of the cutting arm. A cutting arm moved forwards in the direction to the work face does not collide earlier with the loading means, even when the loading ramp or conveying means follow in the direction to the work face, since the cutting appliances operate in an area at some distance from the machine frame corresponding to the displacement of the swivel axis of the cutting arm relative to the work face. At the same time, the advantage arises in the case of such a machine that, when cutting a drift with the cutting appliances, a natural loading chute is cut, which promotes the certain uptake of the cut material by the loading means or conveying means which approach the work face below along the floor.

The structural arrangement here is, in a particularly simple manner, such that the loading ramp is connected with the machine frame via a slotted-link guide for the purpose of displacing the loading ramp in the longitudinal direction of the machine. A slotted-link guide of this kind permits the displacement of the loading ramp or conveyor towards the work face without thereby adversely affecting a swivelling, which may possibly be provided simultaneously, of the loading ramp or conveyor in the upward direction. According to a preferred form of embodiment, the loading ramp or conveyor is articulated on the machine frame to pivot in the direction of elevation, the front edge of the loading ramp or conveyor being pressable against the floor by means of an hydraulic cylinder-piston aggregate, in order to ensure as complete an uptake of the cut material as possible.

According to a preferred development of the arrangement according to the invention, the design is such that the cutting arm is supported on a rocker which can pivot about a horizontal axis extending at right angles to the longitudinal direction of the machine, and that the rocker is connected between the pivot axis of the cutting arm and the pivot axis to the machine frame, for the transmission of a force for the displacement of the loading ramp in the longitudinal direction of the cutting machine. The use of such a rocker for the displacement of the pivot axis of the cutting arm in the direction of the work face thus enables a particularly simple coupling of the displacment movements, it being possible by means of such a rocker to adjust the relationship between the displacment path of the pivot axis of the cutting arm and the displacement path of the loading ramp appropriately. The entraining of the loading ramp or conveying means in the direction to the work face takes place over a shorter displacement path than the displacement of the pivot axis of the cutting arm, thus creating the possibility of cutting a drift with the cutting appliances a natural loading chute remaining in each case when cutting from top to bottom, said chute collecting the cut material and facilitating the carrying away to the conveyor means.

In a design of this kind, the rocker is advantageously connected with the loading ramp via a slotted-link guide having upwardly extending support edges, as a result of which it is ensured that, even in the event of the horizontal swinging of the rocker, the front edge of the loading ramp or conveyor can be pressed against the floor.

BRIEF DESCRIPTION OF THE DRAWINGS

The invention is described hereinafter in more detail by way of an exemplified embodiment which is diagrammatically illustrated in the drawing.

In the Drawings.

DETAILED DESCRIPTION

Figure 1:
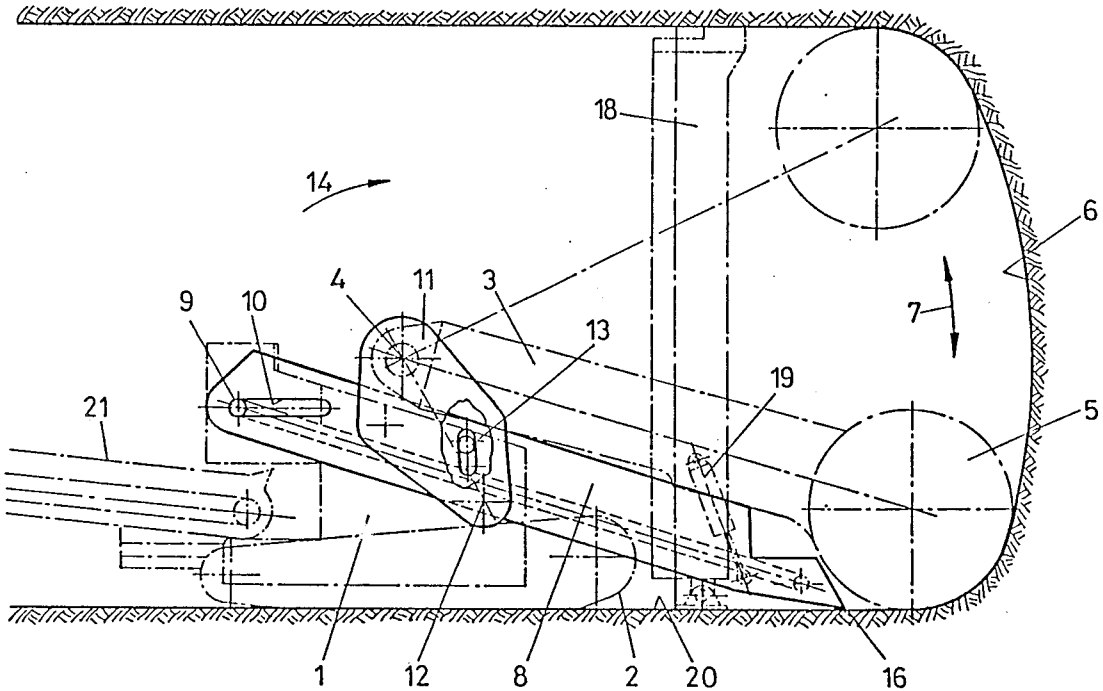
FIG. 1 shows an arrangement according to the invention with retracted loading ramp or retracted conveyor.

In FIG. 1, a cutting machine is diagrammatically designated with reference numeral 1. The cutting machine is provided with endless-track-chassis, the endless tracks of whic hare indicated with reference numeral 2. A cutting arm 3 is supported on the cutting machine to pivot about a substantially horizontal pivot axis 4 orientated at right angles to the longitudinal axis of the machine. The cutting appliances 5 can be cutting heads or drums and, when the cutting arm 3 pivots about the pivot axis 4, the cutting appliances 5 sweep the work face 6 in the direction of the two-way arrow 7.

Also secured to the machine frame is a loading ramp or conveyor 8 to pivot about an axis 9. The pivot axis 9 is incorporated in a slotted link 10 and is in the farthermost retracted position in the illustration according to FIG. 1.

The rocker 11 supporting the swivel 4 of the cutting arm 3 is supported on the machine frame to pivot about an axis 12 which is parallel to the pivot axis 4. The rocker 11 engages with loading ramp or conveyor 8 via a slotted-link guide 13.

Figure 2:
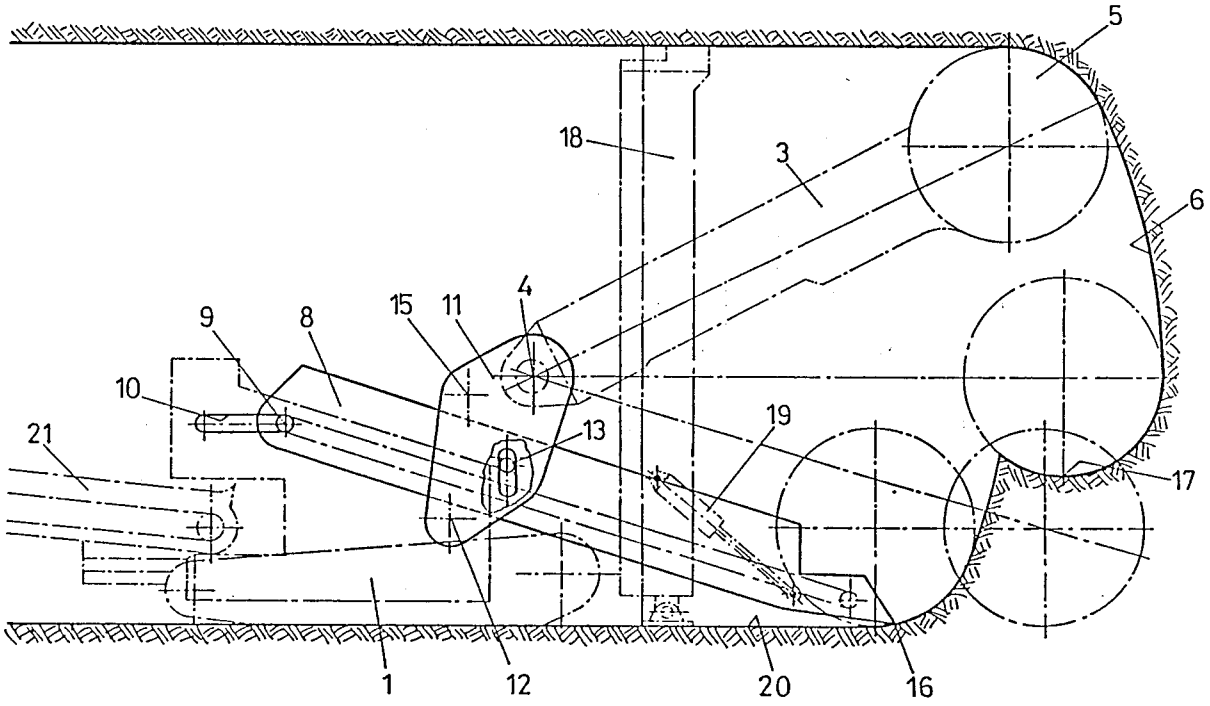
FIG. 2 shows the arrangement of FIG. 1 after swinging of the pivot axis of the cutting arm into a forward position with the simultaneous entraining of the loading ramp or conveyor in the direction of the work face.

When the rocker 11 swings in the direction of the arrow 14, the forward position illustrated in FIG. 2 can be assumed, this swinging being executed by means of an hydraulic cylinder-piston aggregate which can, for example, act on bearing 15, said aggregate not being illustrated in the drawings for the sake of clarity.

When the rocker 11 swings into the position illustrated in FIG. 2, in which position a fresh drift can be cut, the pivot axis 4 of the cutting arm 3 reaches a position closer to the work face 6 without necessitating the displacement of the machine 1. Because of the slotted-link guide 13, the loading ramp or conveyor 8 is simultaneously carried forwrad in that relationship determined by the pivot axis 12 and the position of the slotted-link guide 13, the pivot axis 9 being drawn forward in the slotted-link guide 10. The extent of the displacement of the loading ramp or conveyor 8 in the direction towards the work face is now less than the extent of the relative displacement of the pivot axis 4 towards the work face, in view of the proportions within the rocker, with the result that the front edge 16 of the conveyor or loading ramp 8 remains behind, relative to the cutting heads or cutting drums 5. When cutting a drift the work face not yet cut during downward cutting, forms a type of chute 17, which promotes the certain delivery of the cut material to the front edge 16 of the loading ramp or conveyor 8.

Also evident in FIGS. 1 and 2 is a support 18, which is optionally equipped with a dust-tight partition, between roof and floor, on which support an hydraulic cylinder-piston aggregate 19 acts, pressing the front edge 16 of the loading ramp or conveyor against the floor 20.

A further conveyor 21 is connected to the rear region of the leading ramp or conveyor 8, the former optionally being positioned to be displaceable in the longitudinal direction of the machine, to ensure the reliable takeover of the transported material.

The kinematics of the articulation and displacement of the loading ramp or conveyor 8 can simply be selected in such a way that the front edge 16 of the loading ramp or conveyor 8, when the front edge 16 is pressed against the floor, is always outside the region of collision with the cutting heads or cutting drums so that separate safety precautions against a collision become unnecessary.

We claim:

1. A cutting machine for cutting and carrying away material from a work face, comprising:

a machine frame and means for supporting the machine frame on a floor in front of a work face;

a longitudinally extending cutting arm having a forward end supporting for rotation at least one cutting head or drum;

means mounting said cutting arm, rearwardly of said forward end thereof, to said machine frame for pivoting about a first transverse axis, for raising and lowering said cutting head or drum relative to said first transverse axis;

a longitudinally extending loading ramp or conveyor having a front edge positionable near the work face for receiving and transporting away from the work face material cut from the work face by operation of the cutting head or drum;

means mounting the loading ramp or conveyor to the machine frame for displacement in a longitudinal direction towards and away from the work face;

said means mounting said cutting arm to said machine frame providing for adjustment of position of said first transverse axis longitudinally towards and away from the work face;

means coupling said loading ramp or conveyor to said means for mounting said cutting arm to said machine frame for consequential movement therewith, so that as said cutting head or drum is moved towards and away from the work face relative to the machine frame, the front edge of the loading ramp or conveyor is moved towards and away from the work face.

2. A cutting machine for cutting and carrying away material from a work face, comprising:

a machine frame and means for supporting the machine frame on a floor in front of a work face;

a longitudinally extending cutting arm having a forward end supporting for rotation at least one cutting head or drum;

means mounting said cutting arm, rearwardly of said forward end thereof, to said machine frame for pivoting about a first transverse axis, for raising and lowering said cutting head or drum relative to said first transverse axis;

a longitudinally extending loading ramp or conveyor having a front edge positionable near the work face for receiving and transporting away from the work face material cut from the work face by operation of the cutting head or drum;

means mounting the loading ramp or conveyor to the machine frame for displacement in a longitudinal direction towards and away from the work face;

said means mounting the loading ramp or conveyor to the machine frame comprises a slotted link guide between said loading ramp or conveyor and said machine frame, said slotted link guide comprising a transversally oriented pivot member received in a longitudinally elongated slot.

3. A cutting machine for cutting and carrying away material from a work face, comprising:

a machine frame and means for supporting the machine frame on a floor in front of a work face;

a longitudinally extending cutting arm having a forward end supporting for rotation at least one cutting head or drum;

means mounting said cutting arm, rearwardly of said forward end thereof, to said machine frame for pivoting about a first transverse axis, for raising and lowering said cutting head or drum relative to said first transverse axis;

a longitudinally extending loading ramp or conveyor having a front edge positionable near the work face for receiving and transporting away from the work face material cut from the work face by operation of the cutting head or drum;

means mounting the loading ramp or conveyor to the machine frame for displacment in a longitudinal direction towards and away from the work face;

said means mounting said cutting arm to said machine frame providing for adjustment of position of said first transverse axis longitudinally towards and away from the work face;

said means mounting said cutting arm to said machine frame comprising a rocker on which a first pivot axis member providing said first transverse axis is located, and a second pivot axis member by which said rocker is pivotably mounted to said machine frame for pivotal movement about a second transverse axis; and means connecting said loading ramp or conveyor to the rocker between said first and second transverse axes for causing displacement of the loading ramp or conveyor towards and away from the work face relative to the machine frame as the rocker is pivoted about said second transverse axis for moving said first transverse axis, and therefore said cutting head or drum towards and away from said work face relative to said machine frame.

4. The cutting machine of claim 3, wherein:

said means for connecting said loading ramp or conveyor to said rocker comprises a slotted link guide between said loading ramp or conveyor and said rocker, said slotted link guide comprising a transversally oriented pivot member received in a generally vertically elongated slot.

5. The cutting machine of claim 3, further including:

a support for fixation relative to the floor on which said machine frame, in use, is supported; and an extensible-retractable hydraulic piston-cylinder aggregate mounted between said support and said loading ramp or conveyor, for pressing said front edge of said loading ramp or conveyor against said floor.

* * * * *